US005884539A

United States Patent [19]

Baker

[11] Patent Number: 5,884,539

[45] Date of Patent: Mar. 23, 1999

[54] ADJUSTABLE WRENCH

[75] Inventor: David R. Baker, Fort Worth, Tex.

[73] Assignee: David Baker, Inc., Fort Worth, Tex.

[21] Appl. No.: 873,632

[22] Filed: Jun. 12, 1997

[51] Int. Cl.[6] ..... B25B 13/12; B25B 13/16

[52] U.S. Cl. ..... 81/165; 81/179

[58] Field of Search ..... 81/126, 129, 127, 81/146, 154, 155, 165, 170, 179, 186

[56] References Cited

U.S. PATENT DOCUMENTS

| | | | |
|---|---|---|---|
| 1,380,052 | 5/1921 | Fowble | 81/179 |
| 2,959,996 | 12/1960 | Wheeler | 81/179 |
| 4,706,528 | 11/1987 | Inoue | 81/179 |
| 4,735,121 | 4/1988 | Coulson | 81/129 |
| 5,103,697 | 4/1992 | Masbaum | 81/154 |
| 5,239,899 | 8/1993 | Baker | 81/186 |

*Primary Examiner*—David A. Scherbel
*Assistant Examiner*—Shantese McDonald
*Attorney, Agent, or Firm*—James E. Bradley

[57] ABSTRACT

An adjustable wrench has a positioner member which moves forward and rearward to position a nut generally along a center line of the jaw drive faces. The wrench has a movable jaw with a shank which extends slidingly through a cavity in the stationary jaw. The positioner member has a rearward edge that slidingly engages a forward edge of the shank so that it will move forward relative to the stationary jaw as the movable jaw moves toward the stationary jaw. The positioner member is retained in the cavity with a pin and elongated slot arrangement. The pin extends through side walls of the cavity, or alternately it may be mounted to inner sides of the legs. The legs fit within the cavity stationarily and have a receptacle which slidingly receives a portion of the positioner member. The legs may be retained by lugs on an upper edge and lips on a lower edge. Alternately, the legs may be retained by wedging them apart from each other.

21 Claims, 5 Drawing Sheets

ADJUSTABLE WRENCH

TECHNICAL FIELD

This invention relates in general to adjustable wrenches, and in particular to an adjustable wrench having a positioner member which centers the nut between the jaws.

BACKGROUND ART

In a conventional adjustable wrench, a movable jaw opposes a stationary jaw. The stationary jaw has a cavity which receives a shank of the movable jaw. The shank has teeth on a rearward edge which engage a worm gear mounted rotatably to the stationary jaw. Rotating the worm gear moves the movable drive face toward and away from the stationary drive face to adjust for the nut.

Adjustable wrenches commercially available require that the user tighten the movable jaw on the nut each time the wrench is placed on the nut. Then, to remove the wrench at the end of a stroke, the user normally has to loosen the movable jaw. The user has to retighten the wrench at the beginning of the next stroke. Also, often the worm gear will tend to loosen as the wrench is used. This makes using an adjustable wrench more time consuming than using a conventional fixed jaw wrench. Unless the user is careful, damage to the nut corners will occur due to failure to properly adjust the jaws each time.

U.S. Pat. No. 5,239,899 shows a positioner member which advances and retracts to engage one side of the nut. The positioner member maintains the nut in a desired central position relative to the jaws. The jaws are also curved or arcuate for improved driving. The positioner member is retained by a tongue and groove arrangement with the shank of the movable jaw. Advancing the movable drive face toward and away from the stationary drive face moves the positioner member forward and rearward. In one embodiment of the '899 patent, the stationary drive face is truncated to allow ratcheting action of the adjustable wrench relative to the nut.

DISCLOSURE OF INVENTION

In this invention, an improved retention means is disclosed for retaining the positioner member in the cavity. An elongated transverse slot is formed in the positioner member. One or more pins are stationarily carried in the cavity in engagement with the slot. The pins allow limited forward and rearward movement of the positioner member relative to the stationary member.

In one embodiment, the pin extends through holes provided in the side walls of the cavity. The slot in the positioner member has a portion that extends to one of the edges of the positioner member. This enables the positioner member to be inserted over the pin after the pin has already been installed.

In another embodiment, a retainer is employed. The retainer has a pair of legs which have inner sides that face each other and outer sides which engage opposite sides of the cavity. The legs have mating recesses on their inner sides which define a receptacle. The central portion of the positioner extends through the receptacle, with the rearward edge of the positioner member engaging a forward edge of the shank of the movable jaw. A pair of pins protrude from inner sides of the legs and locate within the elongated slot.

The legs are stationarily retained in the cavity. The legs have lips on the lower end which extend outward and engage lower edges of the cavity to prevent upward movement of the legs within the cavity. In one embodiment, the legs have lugs on the upper edges which protrude laterally outward and engage upper edges of the cavity to prevent downward movement. In another embodiment, the legs are wedged apart by a wedge member to frictionally force them into engagement with the side walls of the cavity. The wedge member is shown in that embodiment to be a screw which engages a tapered hole that is defined by the legs.

Additionally, the wrench has an improved means for transferring force from the movable jaw directly to the stationary jaw, rather than through the worm gear. The stationary jaw has a slide face which extends in a straight line away from the cavity generally perpendicular to the stationary drive face. The movable jaw has a pair of heels on each side of the shank, the heels being parallel to and slidingly engaging the slide face. Parallel grooves are formed on the slide face as well as on the heels. The grooves are dimensioned so that they will ratchet on one another as the worm gear moves the movable jaw to a new position. Once in position and torque is applied, the grooves lock with one another, transferring force directly from the movable jaw through the grooves to the stationary jaw.

BEST MODES FOR CARRYING OUT THE INVENTION

Figure 1:
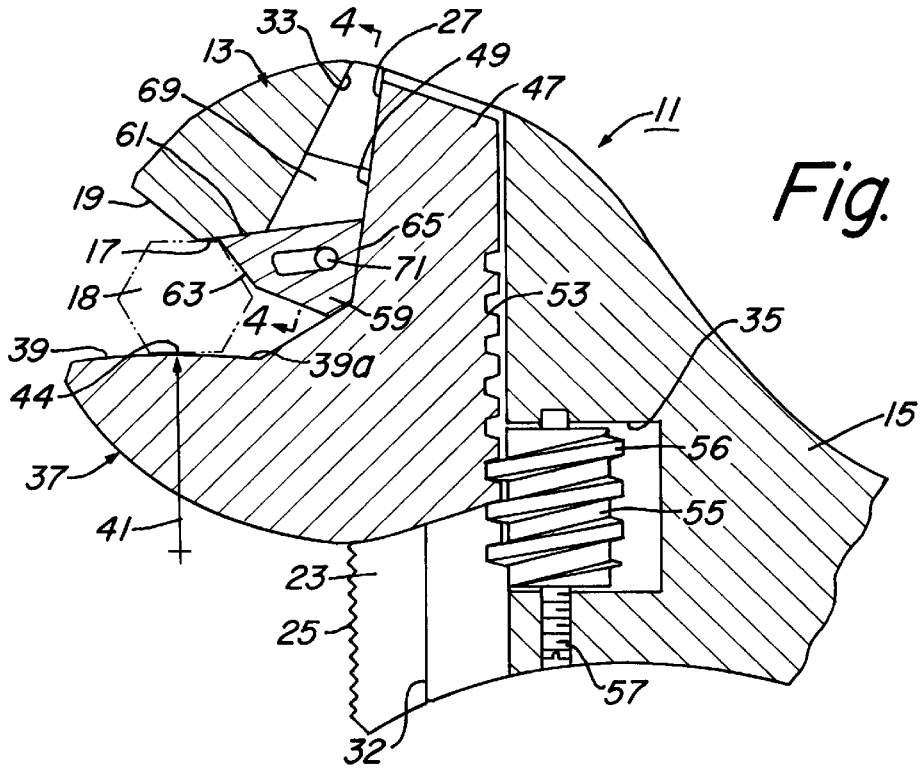
FIG. 1 is a vertical sectional view illustrating an adjustable wrench constructed in accordance with this invention.

Referring to FIG. 1, adjustable wrench 11 has a stationary jaw or member 13 integrally formed with a handle 15.

Figure 5:
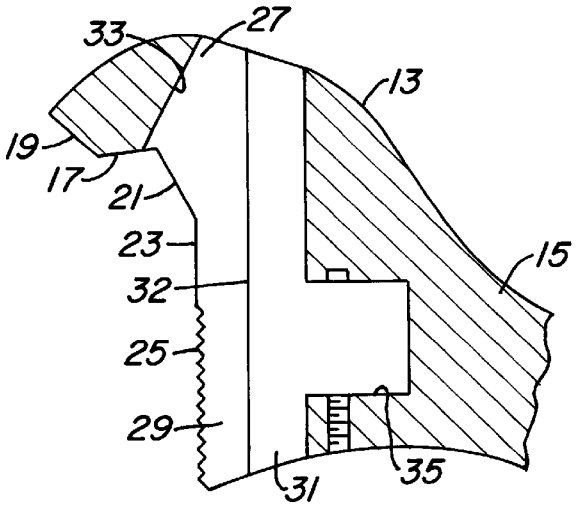
FIG. 5 is a side view of a stationary jaw portion of the adjustable wrench of FIG. 1.

Stationary member 13 has a stationary drive face 17, shown also in FIG. 5, that is arcuate and adapted to engage one side of a nut 18. A flat, truncated nose 19 extends forward from stationary drive face 17 at an angle of about 45°. A backface 21 extends rearward from drive face 17 at about a 60° angle. Backface 21 is also flat and joins a slide face 23 which extends to the lower edge of stationary member 13. In the preferred embodiment, a plurality of grooves 25 are formed on a lower portion of slide face 23. Grooves 25 are small parallel grooves which extend across the thickness of stationary member 13 perpendicular to slide face 23. Each groove 25 is generally triangular with a rounded crest.

Figure 3:
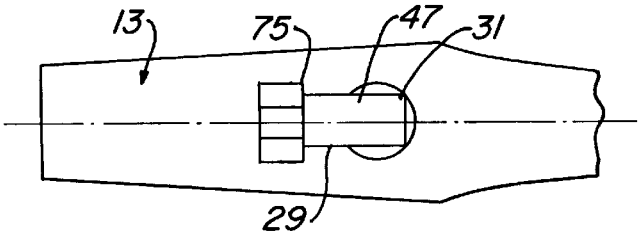
FIG. 3 is a top view of the wrench of FIG. 1.

A cavity 27 extends through stationary member 13 from the lower edge to the upper edge. Cavity 27 has a parallel wall portion 29 that joins and opens to slide face 23, forming a slot. Parallel wall portion 29 has two flat walls laterally spaced apart from each other as shown in FIG. 3 and extends to the upper edge of stationary member 13. Parallel wall portion 29 has a rearward edge which joins a barrel portion 31 at a junction 32. Barrel portion 31 is cylindrical as shown in FIG. 3 and extends from the lower edge to the upper edge of stationary member 13. Junction 32 between barrel portion 31 and parallel wall portion 29 is parallel to slide face 23 and parallel to the axis of barrel portion 31. A plane extending rearward from drive face 17 will intersect junction 32 at an angle of approximately 80°. A forward wall 33 forms the forward edge of cavity 27 and extends from the upper edge to stationary drive face 17. Forward wall 33 inclines rearward at an angle of about 60° relative to stationary drive face 17. A rectangular worm gear slot 35 joins the rearward edge of barrel portion 31. For purposes of this application, "forward" is defined as the direction to the left of the wrench in FIGS. 1, 3, 5, 7–11 and 13 and "rearward" is defined as the direction to the right in the above listed figures.

Figure 6:
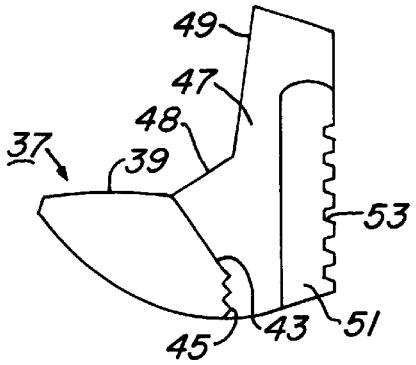
FIG. 6 is a side view of a movable jaw portion of the adjustable wrench of FIG. 1.

Referring to FIGS. 1 and 6, a movable jaw or member 37 is slidably mounted to stationary member 13. Movable member 37 has a drive face 39 that is preferably arcuate along a radius 41 from the forward edge to a midpoint 44 of drive face 39. Drive face 39 has a flat portion 39*a* from midpoint 44 to a bevel surface 43 which inclines downward at an angle in the range from two to five degrees relative to a tangent line at midpoint 44. This tangent line is substantially perpendicular to slide face 23 when movable member 37 is assembled in stationary member 13. Bevel 43 is approximately 45° relative to the tangent line at midpoint 44 between the forward and rearward edges of drive face 39. Bevel 43 leads downward to a heel or clip 45. Clip 45 extends downward from drive face 39 at an angle of substantially 90° relative to the tangent line of midpoint 44. Clip 45 has a plurality grooves 46 for mating with grooves 25. When movable member 37 is assembled with stationary member 13, clip 45 will be substantially parallel with slide face 23.

Figure 7:
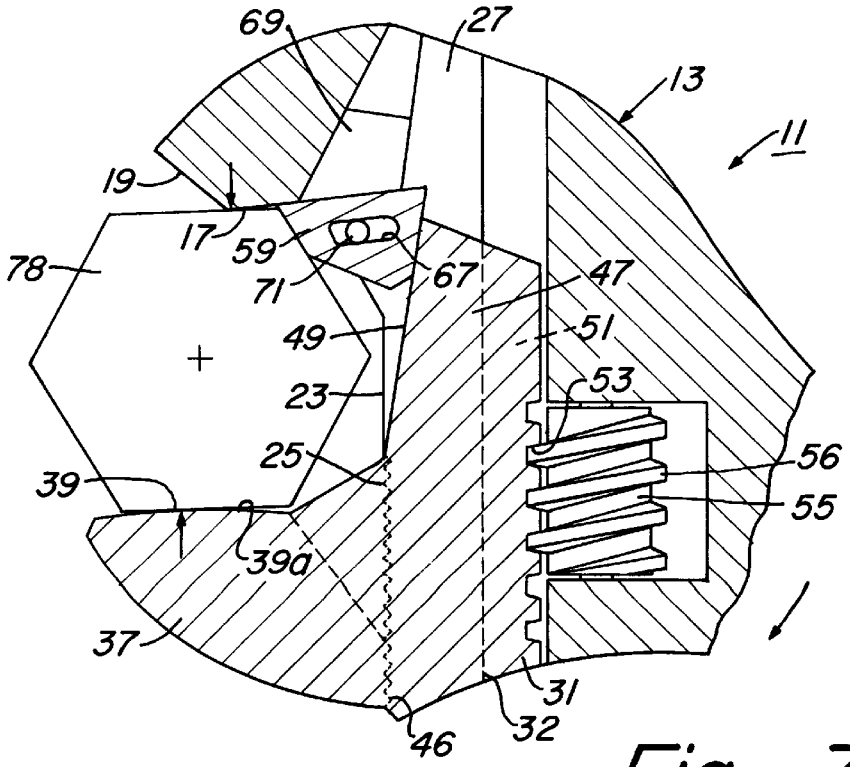
FIG. 7 is another sectional view of the adjustable wrench of FIG. 1, showing the wrench engaging a nut of larger size than of FIG. 1.

Movable member 37 has a shank or web 47 that extends upward for sliding reception within cavity 27 between the parallel walls of parallel wall portion 29. Web 47 is flat and thinner than the thickness of movable member 37 at drive face 39, bevel 43, and clip 45. Web 47 has a backface 48 that joins drive face 39 at about a 30° angle. Backface 48 leads to a wedge wall 49 that extends upward to the upper end of web 47. Wedge wall 49 intersects a line tangent to midpoint 44 of drive face 39 at about 80°. Wedge wall 49 thus inclines rearward relative to slide face 23 and junction 32 at about a ten degree angle. When movable member 37 is assembled in stationary member 13 as illustrated in FIGS. 1 and 7, wedge wall 49 and forward wall 33 incline or converge toward each other. A solid rod or barrel 51 is integrally formed on the rearward edge of movable member 37. Barrel 51 is cylindrical for close reception within barrel portion 31 of cavity 27. Barrel 51 in the embodiment shown does not extend completely to the upper edge of web 47. Barrel 51 has a plurality of teeth 53 formed on its rearward edge. A significant clearance exists between the rearward edge of movable member 37 and the rearward edge of stationary member barrel portion 31.

As shown in FIGS. 1 and 7, a cylindrical worm gear 55 rotatably mounts within cavity 35. Worm gear 55 has threads 56 formed on it for engaging teeth 53 to move movable member 37 toward and away from stationary drive face 17 along an axis parallel with junction 32. Worm gear 55 has an axial bore in it. A pin 57 extends through the bore to secure worm gear 55 to stationary member 13 but allow rotation. Pin 57 may be threaded as shown or fixed.

A nut positioner 59 is carried by stationary member 13 for contact with wedge wall 49. Nut positioner 59 is a small member that moves forward and rearward between retracted and extended positions to center nut 18 as can be seen by comparing FIG. 1 with FIG. 7. Nut positioner 59 may be a plastic member as it does not undergo stress when torque is applied to wrench 11. Nut positioner 59 has an upper edge 61 that slides on stationary drive face 17 as it moves between the extended position shown in FIG. 1 and the retracted position shown in FIG. 7. Nut positioner 59 has a forward edge 63 that is flat and extends downward at a 60° angle relative to upper edge 61. Forward edge 63 is adapted to engage one side of hexagonal nut 18. A rearward edge 65 is formed at an angle for sliding engagement with wedge wall 49. Rearward edge 65 intersects upper edge 61 at approximately an 80° angle.

Figure 2:
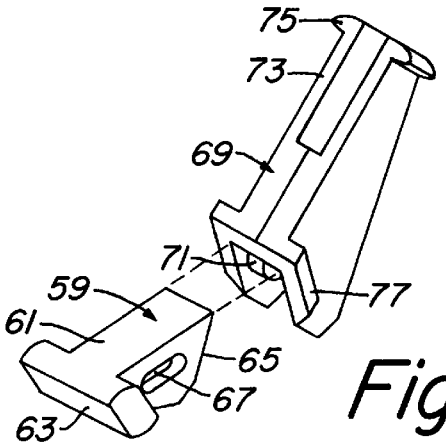
FIG. 2 is a perspective view showing a nut positioner and retainer of the adjustable wrench of FIG. 1.
Figure 4:
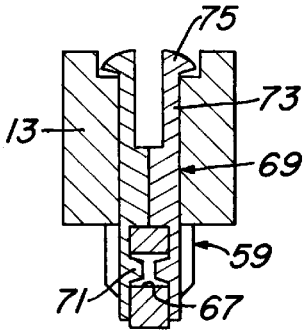
FIG. 4 is a sectional view of the adjustable wrench of FIG. 1 taken along the line 4—4 of FIG. 1.

Nut positioner 59 has an elongated hole 67 which enables it to be carried by a retainer 69. Retainer 69 is also a plastic member and is best illustrated in FIG. 2. Retainer 69 is made up of two halves, each having a laterally protruding pin 71 that inserts into one side of hole 67 to retain nut positioner 59 but allow it to extend and retract. Retainer 69 has two legs 73 that will extend up cavity 27 in the parallel wall portion 29. A pair of outward protruding lugs 75 on the upper end engage small depressions formed at the upper edge of stationary member 13 to prevent downward movement of retainer 69. Lips 77 on the lower edge of retainer 69 engage backface 21 to prevent upward movement of retainer 69 when snapped into place. Legs 73 are spaced apart from each other and sized to resiliently snap retainer 69 into place. Retainer 69 has a tab and slot (not shown) within it that enable the two halves to lock together once inserted within cavity 27 with nut positioner 59 located therein. Retainer 69 remains stationary with stationary member 13 as nut positioner 59 slides between the retracted and extended positions.

In the operation of the embodiment shown in FIGS. 1–8, the user will rotate worm gear 55 to move movable member 37. Because of the clearance between the rearward edge of movable member 37 and the rearward edge of cavity 27, grooves 46 will ratchet over grooves 25 freely as movable member 37 moves toward and away from stationary drive face 17 during adjustment. As the user moves movable member 37 upward by rotating worm gear 55, wedge wall 49 will push nut positioner 59 forward. When movable member 37 is in a lower position as shown in FIG. 7, a greater distance exists between the rearward edge of stationary drive face 17 and wedge wall 49 than when movable member 37 is moved to the upper position shown in FIG. 1. This decrease in dimension occurs because of the angle of wedge wall 49 relative to junction 32 and to stationary drive face 17. The movement of movable member 37 is along an axis parallel to junction 32 as movable member 37 moves upward and downward relative to stationary member 13.

The user continues to rotate worm gear 55 until nut 18 is trapped between drive faces 17 and 39. As nut positioner 59 moves forward it will push nut 18 forward from the rearward edge of stationary drive face 17. Once nut 18 is engaged by drives faces 17, 39, positioner 59 will have placed the center of nut 18 approximately on the midpoint 44 of movable drive face 39. The upper edge of nut 18 will be engaging a forward portion of stationary drive face 17. A significant rearward portion of stationary drive face 17 will be blocked by the extended position of nut positioner 59. The position of nut 18 enables good torque transmission capabilities between flats of nut 18 by driving substantially away from the nut corners.

Referring to FIG. 7, to use wrench 11 with a larger nut 78, the user rotates worm gear 55 in the opposite direction to move movable member 37 downward or away from stationary drive face 17. Because wedge wall 49 will move rearward from stationary drive face 17, nut positioner 59 is free to retract. There need be no spring or mechanism to force nut positioner 59 back. Simply placing wrench 11 on nut 78 will push nut positioner 59 back until its rearward edge 65 engages wedge wall 49. Once drive faces 17, 39 engage nut 78, nut positioner 59 will have approximately centered nut 78 on midpoint 44 of movable drive face 39. A smaller portion of stationary drive face 17 is blocked by nut positioner 59 then when nut 18 is gripped as in FIG. 1.

When applying torque, grooves 25, 46 reduce forces on threads 56 of worm gear 55. Once torque is applied, stationary member 13 cocks or rotates slightly in a clockwise direction relative to movable member 37 due to clearances between barrel 51 and barrel portion 31. This causes grooves 46 and 25 to tightly engage each other. This tight engagement transfers a force on stationary body 13 from grooves 25 directly to grooves 46 and through movable member 37 to nut 18. The transfer of force prevents a tendency for barrel 51 to move upward relative to threads 56. Without grooves 25, 46, an upward force from teeth 53 of barrel 51 is applied to threads 56 of worm gear 55. Grooves 46, 25 reduce and essentially eliminate any force between teeth 53 and threads 56.

When initially positioning wrench 11 on nut 18, movable member 37 is tightened firmly against nut 18. In this tightened position, nut 18 may be driven in a clockwise direction, and also under lighter torque in a counterclockwise direction. Wrench 11 also may be removed and replaced on nut 18 without further adjustment of worm gear 55 for additional non-ratchet drive strokes. In non-ratchet use for light torque applications, wrench 11 may also be flopped over in alternate strokes without further adjustment of worm gear 55, with stationary drive face 17 leading into the direction of rotation rather than lagging as shown in the drawings.

Figure 8:
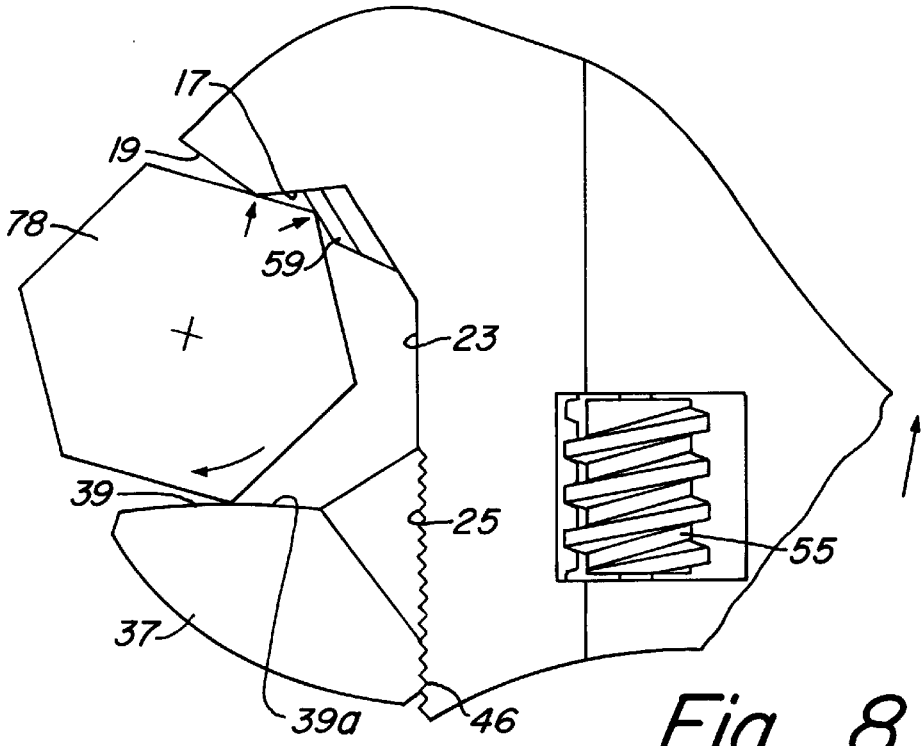
FIG. 8 is a side elevational view of the adjustable wrench of FIG. 1, showing the wrench engaging a nut larger than in FIG. 1 and in the process of ratcheting.
Figure 9:
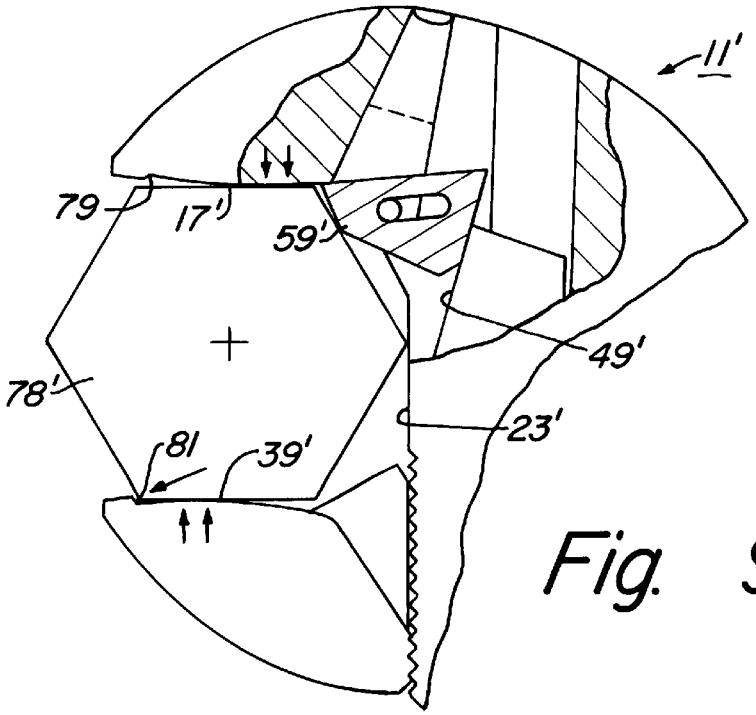
FIG. 9 is a partial sectional view of an alternate embodiment of the adjustable wrench of FIG. 1, showing a non-ratcheting version.
Figure 10:
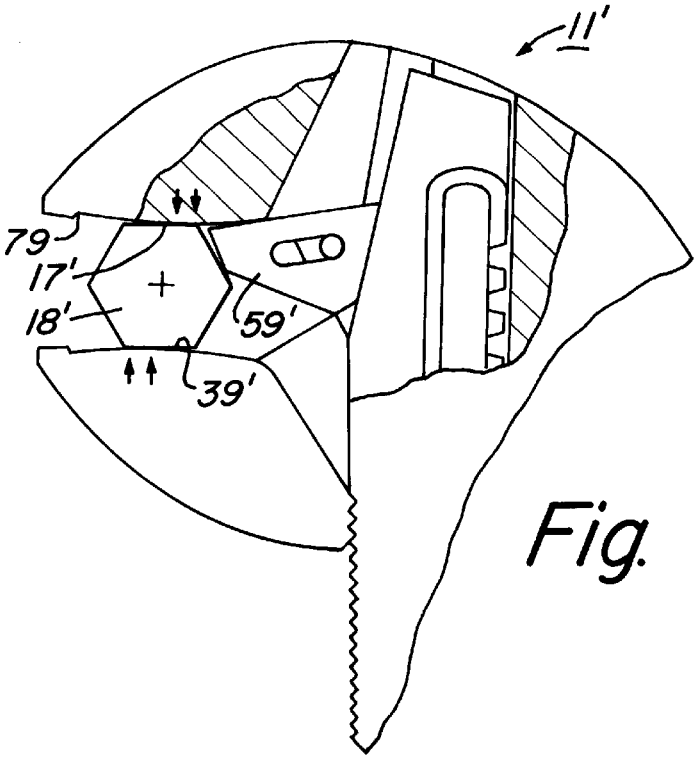
FIG. 10 is a partial sectional view of the adjustable wrench of FIG. 9, showing engaging a smaller nut than in FIG. 9.

The embodiment of FIGS. 1–8 is capable of ratcheting movement as shown by comparing FIGS. 7 and 8. When desiring to drive in a clockwise direction and ratchet to the next drive position without removing wrench 11 from nut 18, initially a slight loosening of wrench 11 on nut 18 is required by rotating worm gear 55 until there is a slight wedge-shaped space between movable drive face portion 39*a* and the rearward portion of a flat on nut 18. Once loosened, ratcheting may occur without further tightening and loosening between strokes. Even though slightly loosened, wrench 11 drives on nut 18 in plane-to-plane engagement for all nut sizes drivable for the particular wrench. When ratcheting, after rotating clockwise as shown in FIG. 7, the user rotates counterclockwise to re-engage flats of nut 78. The forward edge 63 of nut positioner 59 will slide on a corner of nut 78. The corner between nose 19 and stationary drive face 17 will slide on one of the flats of nut 78. Movable drive face 39 will slide on another corner of nut 78 until a new drive position is reached. There is no need to remove wrench 11 from nut 78 when ratcheting to a new drive position. FIGS. 9 and 10 show an embodiment of wrench 11' which does not ratchet but which can apply torque both in clockwise and counterclockwise directions. Some of the similar components to wrench 11 of the embodiments of FIGS. 1–8 are numbered the same but with a prime symbol. In this embodiment, there is no truncated nose 19, as in the first embodiment. Rather, stationary drive face 17' extends further forward and has a notch 79 near its free end. Also, preferably stationary drive face 17' is curved at a radius which is the same as the radius of movable drive face 39'. Movable drive face 39' also has a notch 81 formed in it and does not have a flat rearward portion similar to flat portion 39*a* of FIGS. 1–8. Rather both the forward and rearward portions of drive face 39' are arcuate at the same radius of curvature. In the embodiment of FIGS. 9 and 10, the angle of wedge wall 49' is about 12 degrees relative to slide face 23', rather than about 10 degrees as in the first embodiment. Positioner 59' moves further forward than positioner 59 of the first embodiment as movable drive face 39' moves upward, so that the different sizes of nuts 18', 78' will be placed in the centers of the upper and lower drive faces 17', 39'. The remaining portions of wrench 11' are similar to those in the other embodiments.

When applying torque in a clockwise direction, notch 81 will engage a corner of nut 78' and resist slippage of wrench 11' away from nut 78'. Notch 79 engages a corner of nut 78' when applying torque to the wrench in a counter-clockwise direction. FIG. 10 illustrates wrench 11' in use with a much smaller nut 18' than in FIG. 9. Positioner 59' operates in the same general manner in the embodiment of FIGS. 9 and 10 as in the embodiment of FIGS. 1–8.

Figure 11:
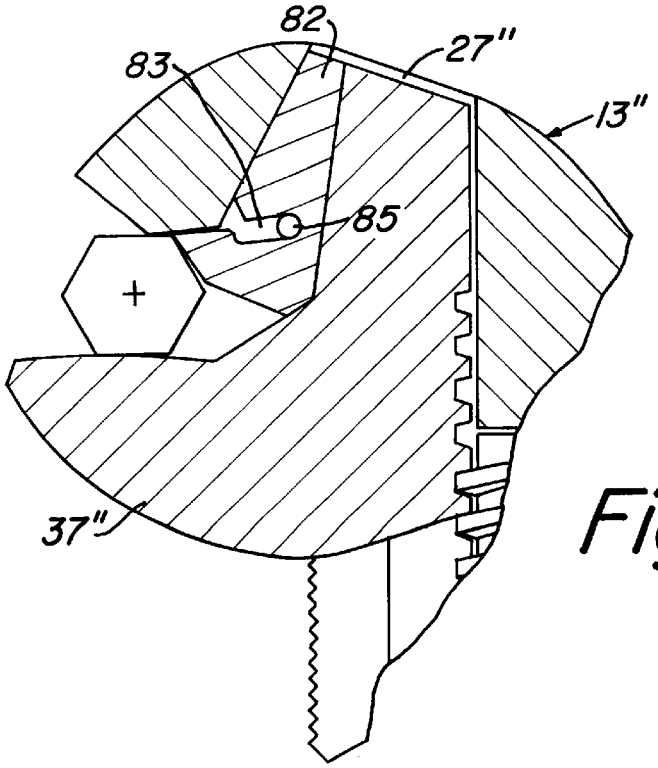
FIG. 11 is a sectional view of an another alternate embodiment of the wrench of FIG. 1, showing a different nut positioner.
Figure 12:
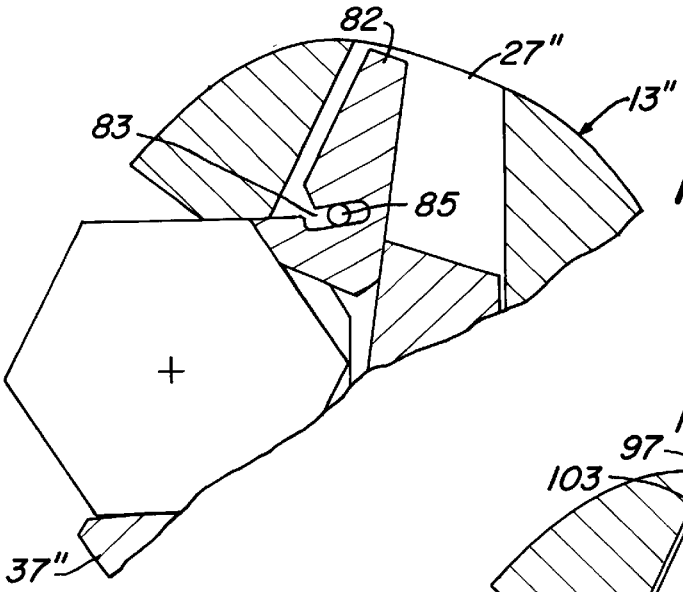
FIG. 12 is a sectional view of the adjustable wrench of FIG. 11, showing the wrench engaging a larger nut than in FIG. 11.

FIGS. 11 and 12 illustrate another embodiment for positioners 59 and 59' of FIGS. 1–10. Some of the similar components to wrench 11 of the embodiments of FIGS. 1–8 are numbered the same but with a double prime symbol. In this embodiment, positioner 82 does not have a retainer 69 as in connection with the other embodiments. The retainer means in this instance comprises a J-slot 83 and pin 85. Pin 85 is secured in holes in stationary member 13", and thus is rigidly secured to stationary member 13". The dimensions of positioner 82 enable it to be dropped into cavity 27" around a pre-installed pin 85 before movable member 37" is installed.

Positioner 82 operates in the same general manner as nut positioners 59, 59' of the other embodiments. It moves between retracted and extended positions as shown by comparing FIGS. 11 and 12.

Figure 13:
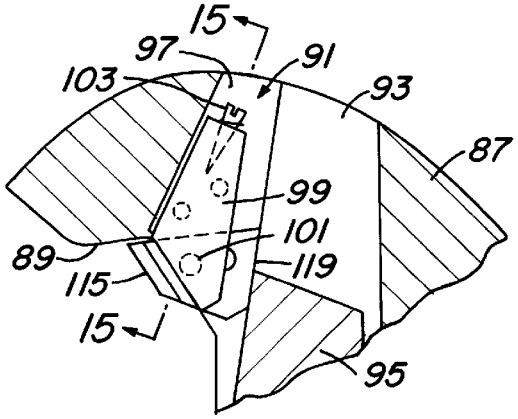
FIG. 13 is a sectional view illustrating a third embodiment of a retainer for retaining the positioner member within the cavity.

FIG. 13 shows another embodiment. Stationary jaw 87 has a stationary drive face 89 that may be truncated as shown for ratcheting, or longer as in FIG. 9. A cavity 91 extends through stationary jaw 87. Cavity 91 has a rearward barrel portion 93 which receives the barrel portion of a shank 95 of a movable jaw. Cavity 91 has a forward portion with parallel flat side walls 97.

Figure 14:
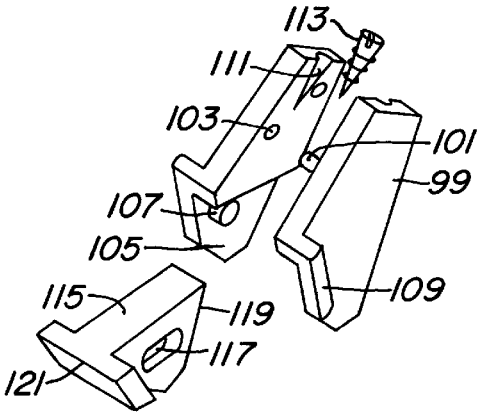
FIG. 14 is a perspective exploded view of the retainer and positioner member of FIG. 13.

A retainer is stationarily retained in cavity 91. The retainer has a pair of side plates or legs 99. As shown also in FIGS. 14–16, legs 99 are maintained in alignment with each other by pins 101 which extends from the inner side of one of the legs 99 into holes 103 formed in the inner side of the other of the legs 99.

Pins 101 fit loosely in holes 103 so that legs 99 may move laterally toward and away from each other.

Each leg 99 has a recess 105 which combines with the other to define a receptacle. A pin 107 protrudes from the inner side of each leg 99 within recess 105. Each leg 99 has a lip 109 that extends laterally from a lower edge. Lip 109 will abut a lower edge of cavity 91 to prevent legs 99 from moving upward within cavity 91.

Figure 15:
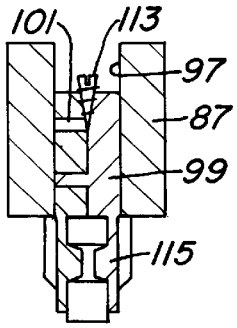
FIG. 15 is a sectional view of the retainer and positioner member of FIG. 13, taken along the line 15—15 of FIG. 13.
Figure 16:
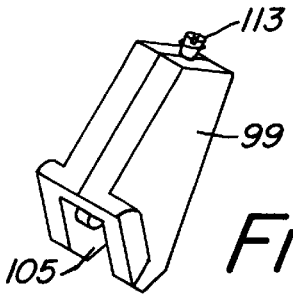
FIG. 16 is perspective view of the retainer of FIG. 13.

A wedge means is employed to wedge legs 99 laterally apart from each other into tight engagement with side walls 97 (FIG. 15). In the embodiment shown, the wedge means includes a tapered recess 111 formed on the inner side of each of the legs 99 at the upper ends. Tapered recesses 111 mate with one another to define a tapered hole. A tapered screw 103 will engage the tapered recesses 111. When tightened, screw 113 forces legs 99 laterally apart from each other to frictionally engage side walls 97. This frictional retention prevents downward movement of legs 99 in cavity 91.

Positioner member 115 is retained by legs 99 in a manner that allows forward and rearward movement of positioner member 115 relative to legs 99. In this embodiment, positioner member 115 has an elongated slot 117 that extends through it perpendicular to rearward edge 119 of positioner member 115. Pins 107 of legs 99 will fit within elongated slot 117 to retain positioner member 115 with legs 99. The length of slot 117 determines the extent of forward and rearward movement allowed of positioner member 115. Positioner member 115 has a forward edge 121 which engages a side of a nut.

The invention has significant advantages. The various retention means for retaining the retainer involves less manufacturing changes to be made to the adjustable wrench than in U.S. Pat. No. 5,239,899. In one embodiment, it is only necessary to provide a drilled hole through the side walls of the cavity to insert a pin. In the other embodiments, the retainers are readily installed in the wrench cavity, yet can be removed if needed for replacement. The retainers may be inexpensive plastic components. The grooves on the heels and slide face of the jaws provide a means to transfer force directly from the removable jaw to the stationary jaw. This reduces the amount of force applied to the worm gear, which prevents damage to worm gear.

While the invention has been shown in several of its forms, it should be apparent to those skilled in the art that it is not so limited but susceptible to various changes without departing from the scope of the invention. For example, although it is preferred to locate the elongated slot in the positioner member and the pin or pins in the stationary jaw, these could be reversed.

I claim:

1. In an adjustable wrench having a stationary jaw with a cavity extending therethrough, a movable jaw opposed to said stationary jaw, said movable and said stationary jaws adapted to engage opposite sides of a nut, said movable jaw having a shank with a forward edge wherein said shank extends slidingly through the cavity, and a nut positioner member which has a rearward edge that slidingly engages the forward edge of the shank for forward movement relative to the stationary jaw as the movable jaw moves toward the stationary jaw, the nut positioner member having a contact surface for contact with a nut, an improved retainer for retaining the nut positioner member in the cavity, comprising:

an elongated slot in the nut positioner member; and a pin stationarily carried in the cavity in engagement with the slot, the pin and the slot allowing limited forward and rearward movement of the nut positioner member relative to the stationary member.

2. The wrench according to claim 1, wherein the slot extends through the nut positioner member transverse to the rearward edge of the nut positioner member.

3. The wrench according to claim 1, wherein the nut positioner member has a forward edge which slidingly engages a forward wall of the cavity; and the slot extends to one of the edges of the nut positioner member for entry of the pin to enable the nut positioner member to be installed in the cavity after installation of the pin.

4. The wrench according to claim 1, wherein the nut positioner member has a forward edge which slidingly engages a forward wall of the cavity; and the slot has a J-portion which extends to the forward edge of the nut positioner member for entry of the pin to enable the nut positioner member to be installed in the cavity after installation of the pin.

5. The wrench according to claim 1, wherein the cavity has two parallel side walls, and the pin extends through the cavity and into holes provided in each of the side walls.

6. The wrench according to claim 1, further comprising:

a pair of legs connected to each other, each having inner sides which face one another and outer sides which engage opposite sides of the cavity, the legs having mating recesses on their inner sides which define a receptacle through which a central portion of the nut positioner member extends; and wherein the pin protrudes from an inner side of one of the legs.

7. The wrench according to claim 1, further comprising:

a pair of legs connected to each other, each having inner sides which face one another and outer sides which engage opposite sides of the cavity, the legs having mating recesses on their inner sides which define a receptacle through which a central portion of the nut positioner member extends;

locking means for stationarily locking the legs in the cavity; and wherein the pin protrudes from an inner side of one of the legs.

8. In an adjustable wrench having a stationary jaw with a cavity extending therethrough, a movable jaw opposed to the stationary jaw, said movable and said stationary jaws adapted to engage opposite sides of a nut, said movable jaw having a shank with a forward edge wherein said shank extends slidingly through the cavity, and a nut positioner member which has a rearward edge that engages the forward edge of the shank for forward movement relative to the stationary jaw as the movable jaw moves toward the stationary jaw, the nut positioner member having a contact surface for contact with a nut, an improved retainer for retaining the nut positioner member in the cavity, comprising:

a pair of legs connected to each other and stationarily mounted in the cavity, each having inner sides which face one another and outer sides which engage opposite sides of the cavity, the legs having mating recesses on their inner sides which define a receptacle through which a central portion of the nut positioner member extends; and a holder in the receptacle which holds the central portion of the nut positioner member in the receptacle and limited forward and rearward movement of the nut positioner member relative to the legs.

9. The wrench according to claim 8 wherein the holder comprises a mating pin and an elongated slot, with one of the pin and the slot being located on the legs and the other of the pin and the slot being located on the nut positioner member.

10. The wrench according to claim 8 wherein the holder comprises:

an elongated slot located in the nut positioner member; and a pin which extends from one of the legs into the slot.

11. The wrench according to claim 8 wherein the holder comprises:

an elongated slot extending transversely through the central portion of the nut positioner member; and a pin which extends inwardly from each of the legs into the slot.

12. The wrench according to claim 8, further comprising locking means for locking the legs stationarily in the cavity.

13. The wrench according to claim 8, further comprising:

a laterally protruding lip on a lower end of each of the legs which engages a lower edge of the cavity to prevent upward movement of the legs in the cavity; and a laterally protruding lug on an upper end of each of the legs which engages an upper edge of the cavity to prevent downward movement of the legs in the cavity.

14. The wrench according to claim 8, further comprising:

a wedge member which urges the legs outwardly apart from each other into tight frictional engagement with the sides of the cavity.

15. The wrench according to claim 8, further comprising:

tapered recesses formed in upper ends of the legs which mate to define a tapered hole; and a tapered screw which threads into the tapered hole to urge the legs outwardly apart from each other into tight frictional engagement with the sides of the cavity.

16. In an adjustable wrench having a stationary jaw with a cavity extending therethrough, a movable jaw opposed to the stationary jaw, said movable jaw having a shank with a forward edge wherein said shank extends slidingly through the cavity, and a nut positioner member which has a rearward edge that engages a forward edge of the shank for forward movement relative to the stationary jaw as the movable jaw moves toward the stationary jaw, the nut positioner member having a contact surface for contact with a nut, an improved retainer for retaining the nut positioner member in the cavity, comprising:

a pair of legs connected to each other, each having inner sides which face one another and outer sides which engage opposite sides of the cavity, the legs having mating recesses on their inner sides which define a receptacle through which a central portion of the nut positioner member extends;

a laterally outward protruding lip on a lower end of each of the legs which engages a lower edge of the cavity to prevent upward movement of the legs in the cavity;

a lock which secures the legs with the cavity to prevent downward movement of the legs in the cavity; and a mating pin and elongated slot assembly between the legs and the nut positioner member to allow limited forward and rearward movement of the nut positioner member relative to the legs.

17. The wrench according to claim 16 wherein the mating pin and elongated slot assembly comprises:

an elongated slot extending through the nut positioner member perpendicular to the rearward edge; and a pair of pins, each of the pins protruding inward from the inner side of one of the legs into engagement with the elongated slot.

18. The wrench according to claim 16, wherein the lock comprises:

an outward protruding lug on an upper end of each of the legs which engages an upper edge of the cavity to prevent downward movement of the legs in the cavity.

19. The wrench according to claim 16, wherein the lock comprises:

a wedge member which urges the legs outwardly apart from each other into tight frictional engagement with the sides of the cavity.

20. The wrench according to claim 16, wherein the lock comprises:

tapered recesses formed in upper ends of the legs which mate to define a tapered hole; and a tapered screw which threads into the tapered hole to urge the legs outwardly apart from each other into tight frictional engagement with the sides of the cavity.

21. An adjustable wrench, comprising in combination:

a stationary jaw having a stationary drive face, a cavity extending through the stationary jaw, and a slide face extending away from the cavity generally perpendicular to the stationary drive face;

a movable jaw having a movable drive face opposed to the stationary drive face, the movable jaw having a shank which extends slidingly through the cavity and a pair of heels on opposite sides of the shank, each of the heels being parallel to and slidingly engaging the slide face, the movable jaw having a rearward edge containing a set of teeth;

a worm gear carried rotatably by the stationary jaw in engagement with the teeth for selectively moving the movable drive face toward and away from the stationary drive face;

a set of parallel grooves formed on the slide face; and a set of parallel grooves formed on each of the heels which engage the grooves on the slide face to transfer loading from the movable jaw to the stationary jaw while torque is being applied to the wrench, the sets of grooves being dimensioned to ratchet on each other while the movable jaw is being moved relative to the stationary jaw.

* * * * *